US010082331B2

(12) United States Patent
Evans et al.

(10) Patent No.: US 10,082,331 B2
(45) Date of Patent: Sep. 25, 2018

(54) PROCESS FOR CONTROLLING LIQUEFIED NATURAL GAS HEATING VALUE

(75) Inventors: Megan V. Evans, Houston, TX (US); Nasir Ali, Houston, TX (US); Jon M. Mock, Katy, TX (US); Jame Yao, Sugar Land, TX (US); Sriram Ramani, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 1461 days.

(21) Appl. No.: 12/833,500

(22) Filed: Jul. 9, 2010

(65) Prior Publication Data

US 2011/0011127 A1 Jan. 20, 2011

Related U.S. Application Data

(60) Provisional application No. 61/226,164, filed on Jul. 16, 2009.

(51) Int. Cl.

| | |
|---|---|
| ***F25J 1/02*** | (2006.01) |
| ***F25J 1/00*** | (2006.01) |
| ***F25J 3/02*** | (2006.01) |

(52) U.S. Cl.

CPC ..... *F25J 1/0237* (2013.01); *F25J 1/004* (2013.01); *F25J 1/0022* (2013.01); *F25J 1/0052* (2013.01); *F25J 1/021* (2013.01); *F25J 1/023* (2013.01); *F25J 1/0238* (2013.01); *F25J 3/0209* (2013.01); *F25J 3/0233* (2013.01); *F25J 3/0238* (2013.01); *F25J 3/0242* (2013.01); *F25J 2200/02* (2013.01); *F25J 2200/04* (2013.01); *F25J 2200/74* (2013.01); *F25J 2200/76* (2013.01); *F25J 2200/78* (2013.01); *F25J 2220/64* (2013.01); *F25J 2230/60* (2013.01); *F25J 2245/02* (2013.01); *F25J 2260/60* (2013.01); *F25J 2270/12* (2013.01)

(58) Field of Classification Search

CPC ..... F25J 1/023; F25J 1/0231; F25J 3/04533; F25J 3/04539; F25J 3/045545; F25J 2260/60

USPC ..... 62/611–621

See application file for complete search history.

(56) References Cited

U.S. PATENT DOCUMENTS

| | | | | |
|---|---|---|---|---|
| 4,102,659 | A * | 7/1978 | Martin | 62/625 |
| 6,401,486 | B1 | 6/2002 | Lee et al. | |
| 6,662,589 | B1 * | 12/2003 | Roberts et al. | 62/425 |
| 6,925,837 | B2 | 8/2005 | Eaton | |
| 7,210,311 | B2 | 5/2007 | Wilkinson et al. | |
| 8,209,997 | B2 * | 7/2012 | Malsam | 62/630 |

(Continued)

FOREIGN PATENT DOCUMENTS

| | | |
|---|---|---|
| FR | 2923001 | 5/2009 |
| WO | 2004005440 A1 | 1/2004 |

(Continued)

OTHER PUBLICATIONS

International Search Report. PCT/US2010/041955, dated Jan. 5, 2015.

*Primary Examiner* — Jianying Atkisson
*Assistant Examiner* — Meraj A Shaikh
(74) *Attorney, Agent, or Firm* — ConocoPhillips Company

(57) ABSTRACT

Process for efficiently operating a natural gas liquefaction system with integrated heavies removal/natural gas liquids recovery to produce liquefied natural gas (LNG) and/or natural gas liquids (NGL) products.

11 Claims, 2 Drawing Sheets

(56) References Cited

U.S. PATENT DOCUMENTS

| | | | | |
|---|---|---|---|---|
| 2004/0244415 | A1* | 12/2004 | Paradowski | 62/612 |
| 2007/0012072 | A1 | 1/2007 | Qualls et al. | |
| 2007/0149838 | A1 | 6/2007 | Chretien | |
| 2007/0157663 | A1 | 7/2007 | Mak et al. | |
| 2008/0256976 | A1* | 10/2008 | Eaton | 62/612 |
| 2009/0076357 | A1 | 3/2009 | Purdy | |
| 2011/0048067 | A1 | 3/2011 | Fischer et al. | |

FOREIGN PATENT DOCUMENTS

| | | | |
|---|---|---|---|
| WO | 2005072144 | A2 | 8/2005 |
| WO | 2006009646 | A2 | 1/2006 |
| WO | 2006087331 | A1 | 8/2006 |

* cited by examiner

PROCESS FOR CONTROLLING LIQUEFIED NATURAL GAS HEATING VALUE

CROSS-REFERENCE TO RELATED APPLICATIONS

This application claims priority benefit under 35 U.S.C. Section 119(e) to U.S. Provisional Patent Ser. No. 61/226,164 filed on Jul. 16, 2009 the entire disclosure of which is incorporated herein by reference.

FIELD OF THE INVENTION

The invention relates to a process for liquefying natural gas. In another aspect, the invention concerns an LNG process employing a heavies removal system. In another aspect, the invention concerns controlling the heating value of LNG.

BACKGROUND OF THE INVENTION

The cryogenic liquefaction of natural gas is routinely practiced as a means of converting natural gas into a more convenient form for transportation and/or storage. Generally, liquefaction of natural gas reduces its volume by about 600-fold, thereby resulting in a liquefied product that can be readily stored and transported at near atmospheric pressure.

Natural gas is frequently transported by pipeline from the supply source to a distant market. It is desirable to operate the pipeline under a substantially constant and high load factor, but often the deliverability or capacity of the pipeline will exceed demand while at other times the demand will exceed the deliverability of the pipeline. In order to shave off the peaks where demand exceeds supply or the valleys where supply exceeds demand, it is desirable to store the excess gas in such a manner that it can be delivered as the market dictates. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source that is separated by great distances from the candidate market, and a pipeline either is not available or is impractical. This is particularly true where transport must be made by ocean-going vessels. Ship transportation of natural gas in the gaseous state is generally not practical because appreciable pressurization is required to significantly reduce the specific volume of the gas, and such pressurization requires the use of more expensive storage containers.

In view of the foregoing, it would be advantageous to store and transport natural gas in the liquid state at approximately atmospheric pressure. In order to store and transport natural gas in the liquid state, the natural gas is cooled to −240° F. to −260° F. where the liquefied natural gas (LNG) possesses a near-atmospheric vapor pressure.

Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology that may be particularly applicable to one or more embodiments of the present invention employs an open methane cycle for the final refrigeration cycle wherein a pressurized LNG-bearing stream is flashed and the flash vapors are subsequently employed as cooling agents, recompressed, cooled, combined with the processed natural gas feed stream, and liquefied, thereby producing the pressurized LNG-bearing stream.

LNG heating value is frequently a limit in the operation of an LNG plant. In many cases, no economics exist for the recovery of liquid petroleum gas (LPG) from natural gas. However, resulting LNG streams will have a heating value or LPG components in excess of that specified by the LNG market. It is common then to recover LPGs from the gas prior to liquefaction. In many cases there is no market price differential between products as LNG and LPG. Investments for capital costs associated with recovery, fractionation and storage of the LPGs thus would have no economic basis, except that provided by the base LNG economics. In many cases, feed gas composition to a plant will vary over time. Thus, gas may be higher or lower in LPG concentrations. This variation in feed composition may result in investments later in the life necessary to deal with these changing feed gas compositions.

SUMMARY OF THE INVENTION

In one embodiment of the present invention there is provided a process for producing liquefied natural gas (LNG). The process includes the following steps: (a) introducing at least a portion of the natural gas stream from a liquefaction system into a first heat exchanger, thereby producing a first cooled stream; (b) introducing at least a portion of the natural gas stream into a first distillation column, whereby prior to entry into the first distillation column the stream is combined with the first cooled stream; (c) using the first distillation column to separate the combined stream into a first predominately vapor stream and a first predominately liquid bottoms stream; (d) removing the first predominately vapor stream from the first distillation column and reintroducing the first predominately vapor stream into the liquefaction system; (e) removing the first predominately liquid bottoms stream from the first distillation column and introducing the first predominately liquid bottoms stream into the first heat exchanger, thereby producing a second heated stream; (f) reintroducing at least a portion of the second heated stream into the bottom of the first distillation column; (g) introducing the remaining portion of the second heated stream into a second distillation column; (h) using the second distillation column to separate at least a portion of the second heated stream into a second predominately liquid bottoms stream and a second predominately vapor stream; (i) removing the second predominately vapor stream from the second distillation column and introducing the second predominately vapor stream into a second heat exchanger in indirect heat exchange with an external coolant, thereby producing a third cooled stream; (j) introducing the third cooled stream into a separation vessel to thereby separate the third cooled stream into a third vapor fraction and a third liquid fraction; and (k) introducing at least a portion of the third vapor fraction into the fuel gas system, wherein the at least a portion of the third vapor fraction is relatively concentrated in ethane and propane, returning the remaining portion of the third vapor fraction to the methane system.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Figure 1A:
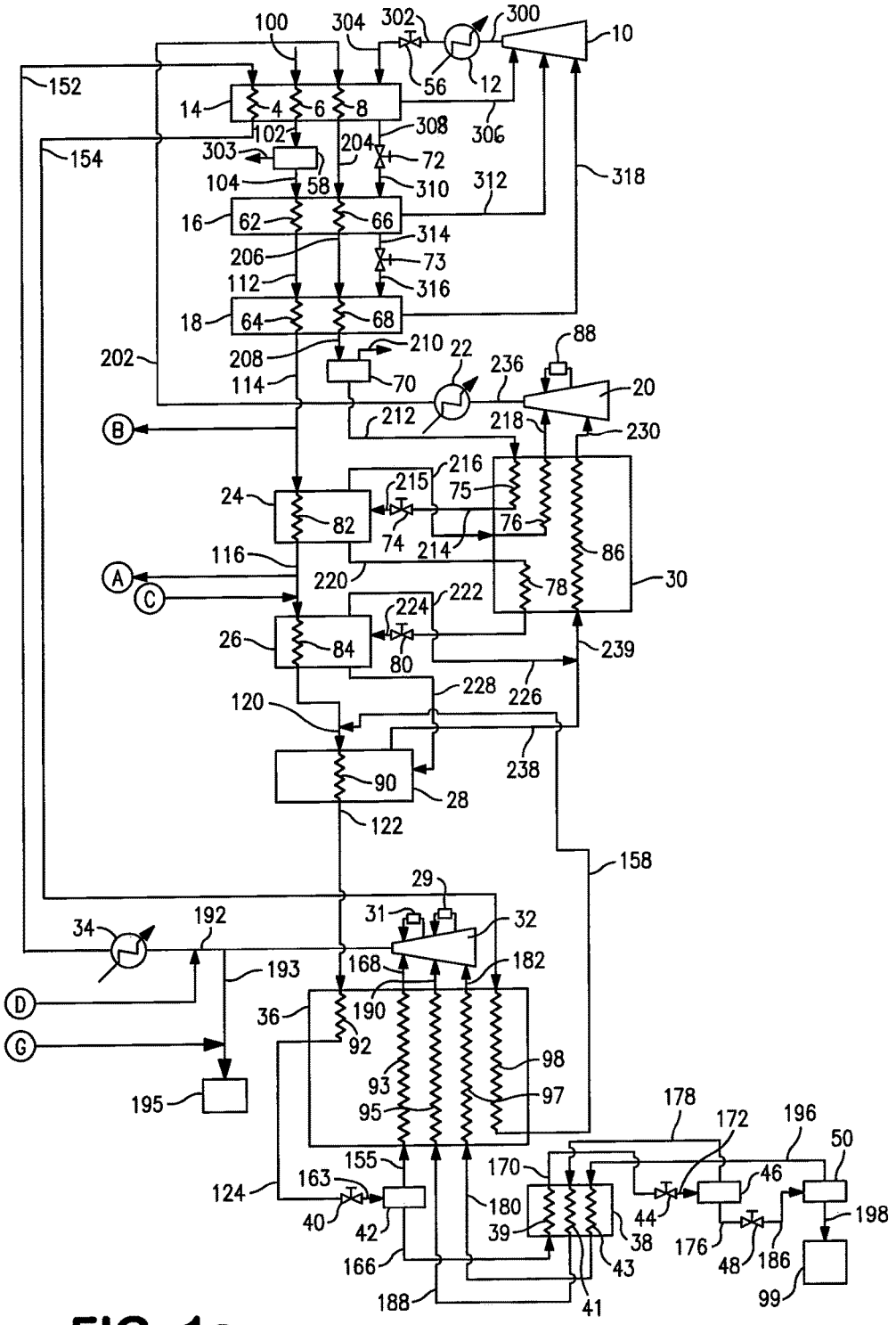
FIG. 1*a* is a simplified flow diagram of a cascaded refrigeration process for producing LNG with certain portion of the LNG facility connecting to line A, B, C, D, and G being illustrated in FIG. 1*b*.

Reference will now be made in detail to embodiments of the invention, once or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instances, features illustrated or described as part of one embodiment can be used on another embodiment to yield a still further embodiment. Thus, it is intended that the present invention cover such modifications and variations that come within the scope of the appended claims and their equivalents.

In the description which follows, like parts are marked throughout the specification and drawing with the same reference numerals, respectively. The drawing figures are not necessarily to scale and certain features are shown in schematic form or are exaggerated in scale in the interest of clarity and conciseness.

The present invention can be implemented in a process/facility used to cool natural gas to its liquefaction temperature, thereby producing liquefied natural gas (LNG). The LNG process generally employs one or more refrigerants to extract heat from the natural gas and then reject the heat to the environment. In one embodiment, the LNG process employs a cascade-type refrigeration process that uses a plurality of multi-stage cooling cycles, each employing a different refrigerant composition, to sequentially cool the natural gas stream to lower and lower temperatures. In another embodiment, the LNG process is a mixed refrigerant process that employs at least one refrigerant mixture to cool the natural gas stream.

Natural gas can be delivered to the LNG process at an elevated pressure in the range of from about 500 to about 3,000 pounds per square in absolute (psia), about 500 to about 1,000 psia, or 600 to 800 psia. Depending largely upon the ambient temperature, the temperature of the natural gas delivered to the LNG process can generally be in the range of from about 0 to about 180° F., about 20 to about 150° F., or 60 to 125° F.

In one embodiment, the present invention can be implemented in an LNG process that employs cascade-type cooling followed by expansion-type cooling. In such a liquefaction process, the cascade-type cooling may be carried out at an elevated pressure (e.g., about 650 psia) by sequentially passing the natural gas stream through first, second, and third refrigeration cycles employing respective first, second, and third refrigerants. In one embodiment, the first and second refrigeration cycles are closed refrigeration cycles, while the third refrigeration cycle is an open refrigeration cycle that utilizes a portion of the processed natural gas as a source of the refrigerant. The third refrigeration cycle can include a multi-stage expansion cycle to provide additional cooling of the processed natural gas stream and reduce its pressure to near atmospheric pressure.

In the sequence of first, second, and third refrigeration cycles, the refrigerant having the highest boiling point can be utilized first, followed by a refrigerant having an intermediate boiling point, and finally by a refrigerant having the lowest boiling point. In one embodiment, the first refrigerant has a mid-boiling point within about 20, about 10, or 5° F. of the boiling point of pure propane at atmospheric pressure. The first refrigerant can contain predominately propane, propylene, or mixtures thereof. The first refrigerant can contain at least about 75 mole percent propane, at least 90 mole percent propane, or can consist essentially of propane. In one embodiment, the second refrigerant has a mid-boiling point within about 20, about 10, or 5° F. of the boiling point of pure ethylene at atmospheric pressure. The second refrigerant can contain predominately ethane, ethylene, or mixtures thereof. The second refrigerant can contain at least about 75 mole percent ethylene, at least 90 mole percent ethylene, or can consist essentially of ethylene. In one embodiment, the third refrigerant has a mid-boiling point within about 20, about 10, or 5° F. of the boiling point of pure methane at atmospheric pressure. The third refrigerant can contain at least about 50 mole percent methane, at least about 75 mole percent methane, at least 90 mole percent methane, or can consist essentially of methane. At least about 50, about 75, or 95 mole percent of the third refrigerant can originate from the processed natural gas stream.

The first refrigeration cycle can cool the natural gas in a plurality of cooling stages/steps (e.g., two to four cooling stages) by indirect heat exchange with the first refrigerant. Each indirect cooling stage of the refrigeration cycles can be carried out in a separate heat exchanger. In one embodiment, core-and-kettle heat exchangers are employed to facilitate indirect heat exchange in the first refrigeration cycle. After being cooled in the first refrigeration cycle, the temperature of the natural gas can be in the range of from about −45 to about −10° F., about −40 to about −15° F., or −20 to −30° F. A typical decrease in the natural gas temperature across the first refrigeration cycle may be in the range of from about 50 to about 210° F., about 75 to about 180° F., or 100 to 140° F.

The second refrigeration cycle can cool the natural gas in a plurality of cooling stages/steps (e.g., two to four cooling stages) by indirect heat exchange with the second refrigerant. In one embodiment, the indirect heat exchange cooling stages in the second refrigeration cycle can employ separate, core-and-kettle heat exchangers. Generally, the temperature drop across the second refrigeration cycle can be in the range of from about 50 to about 180° F., about 75 to about 150° F., or 100 to 120° F. In the final stage of the second refrigeration cycle, the processed natural gas stream can be condensed (i.e., liquefied) in major portion, preferably in its entirety, thereby producing a pressurized LNG-bearing stream. Generally, the process pressure at this location is only slightly lower than the pressure of the natural gas fed to the first stage of the first refrigeration cycle. After being cooled in the second refrigeration cycle, the temperature of the natural gas may be in the range of from about −205 to about −70° F., about −175 to about −95° F., or −140 to −125° F.

The third refrigeration cycle can include both an indirect heat exchange cooling section and an expansion-type cooling section. To facilitate indirect heat exchange, the third refrigeration cycle can employ at least one brazed-aluminum plate-fin heat exchanger. The total amount of cooling provided by indirect heat exchange in the third refrigeration cycle can be in the range of from about 5 to about 60° F., about 7 to about 50° F., or 10 to 40° F.

The expansion-type cooling section of the third refrigeration cycle can further cool the pressurized LNG-bearing stream via sequential pressure reduction to approximately atmospheric pressure. Such expansion-type cooling can be accomplished by flashing the LNG-bearing stream to thereby produce a two-phase vapor-liquid stream. When the third refrigeration cycle is an open refrigeration cycle, the expanded two-phase stream can be subjected to vapor-liquid separation and at least a portion of the separated vapor phase (i.e., the flash gas) can be employed as the third refrigerant to help cool the processed natural gas stream. The expansion of the pressurized LNG-bearing stream to near atmospheric pressure can be accomplished by using a plurality of expansion steps (i.e., two to four expansion steps) where each expansion step is carried out using an expander. Suitable expanders include, for example, either Joule-Thomson expansion valves or hydraulic expanders. In one embodiment, the third refrigeration cycle can employ three sequential expansion cooling steps, wherein each expansion step can be followed by a separation of the gas-liquid product. Each expansion-type cooling step can cool the LNG-bearing stream in the range of from about 10 to about 60° F., about 15 to about 50° F., or 25 to 35° F. The reduction in pressure across the first expansion step can be in the range of from about 80 to about 300 psia, about 130 to about 250 psia, or 175 to 195 psia. The pressure drop across the second expansion step can be in the range of from about 20 to about 110 psia, about 40 to about 90 psia, or 55 to 70 psia. The third expansion step can further reduce the pressure of the LNG-bearing stream by an amount in the range of from about 5 to about 50 psia, about 10 to about 40 psia, or 15 to 30 psia. The liquid fraction resulting from the final expansion stage is the final LNG product. Generally, the temperature of the final LNG product can be in the range of from about −200 to about −300° F., about −225 to about −275° F., or −240 to −260° F. The pressure of the final LNG product can be in the range of from about 0 to about 40 psia, about 10 to about 20 psia, or 12.5 to 17.5 psia.

The natural gas feed stream to the LNG process usually contains such quantities of C.sub.2+ components so as to result in the formation of a C.sub.2+ rich liquid in one or more of the cooling stages of the second refrigeration cycle. Generally, the sequential cooling of the natural gas in each cooling stage is controlled so as to remove as much of the C.sub.2 and higher molecular weight hydrocarbons as possible from the gas, thereby producing a vapor stream predominating in methane and a liquid stream containing significant amounts of ethane and heavier components. This liquid can be further processed via gas-liquid separators employed at strategic locations downstream of the cooling stages. In one embodiment, one objective of the gas/liquid separators is to maximize the rejection of the C.sub.5+ material to avoid freezing in downstream processing equipment. The gas/liquid separators may also be utilized to vary the amount of C.sub.2 through C.sub.4 components that remain in the natural gas product to affect certain characteristics of the finished LNG product. The exact configuration and operation of gas-liquid separators may be dependant on a number of parameters, such as the C.sub.2+ composition of the natural gas feed stream, the desired BTU content (i.e., heating value) of the LNG product, the value of the C.sub.2+ components for other applications, and other factors routinely considered by those skilled in the art of LNG plant and gas plant operation.

In one embodiment of the present invention, the LNG process can include natural gas liquids (NGL) integration within the LNG facility. One may significantly enhance the efficiency of LNG production and NGL recovery by integrating the two functions in one facility.

Figure 1B:
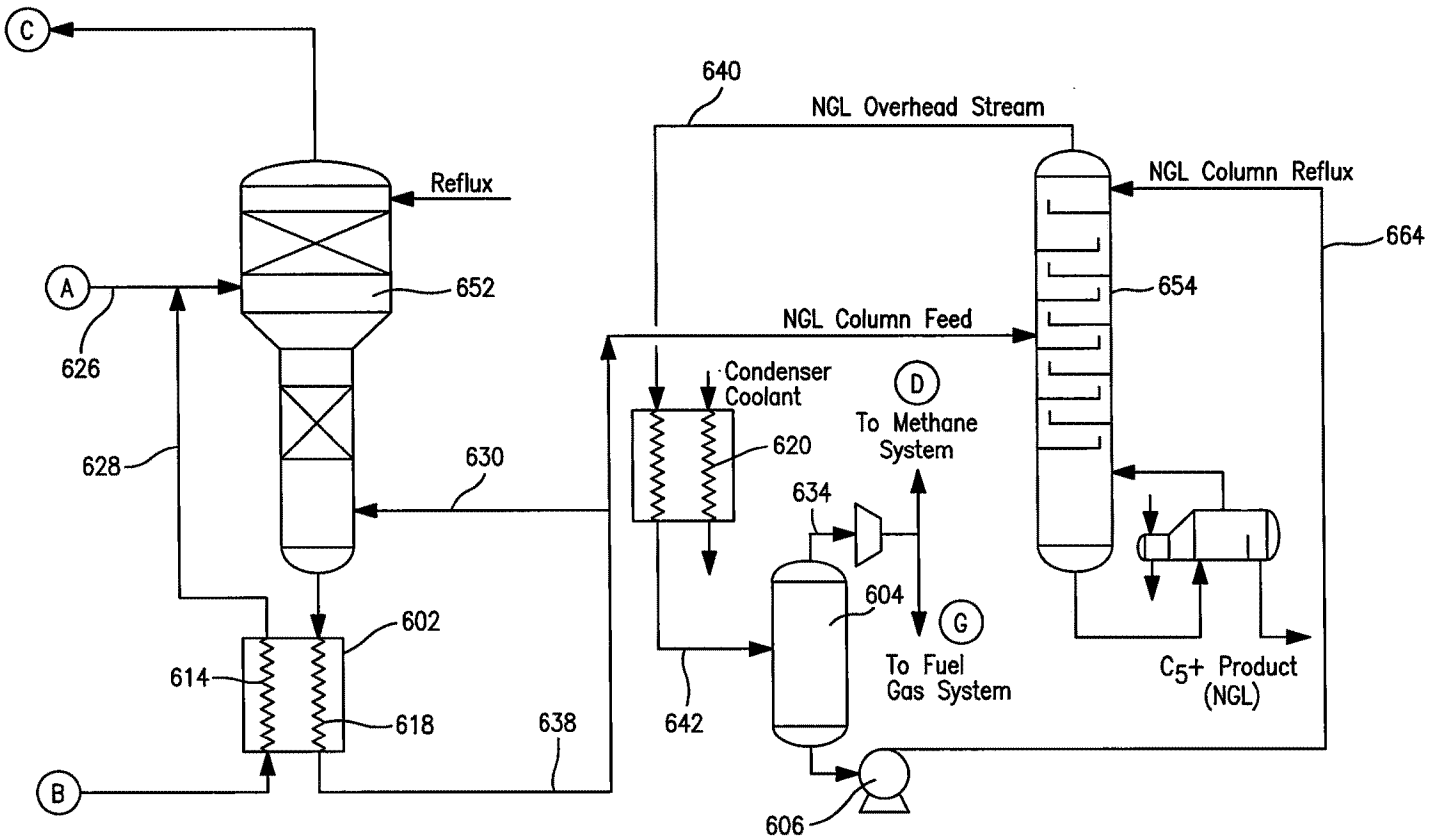
FIG. 1*b* is a flow diagram showing an integrated heavies removal/NGL recovery system connected to the LNG facility of FIG. 1*a* via lines A, B, C, D, and G.

LNG facilities capable of being operated in accordance with the present invention can have a variety of configurations. The flow schematics and apparatuses illustrated in FIGS. 1*a* and 1*b* represent several embodiments of inventive LNG facilities capable of efficiently supplying and controlling the heating value of LNG products. FIG. 1*b* represents various embodiments of the integrated heavies removal/NGL recovery system of the inventive LNG facility. Those skilled in the art will recognize that FIGS. 1*a* and 1*b* are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

The inventive LNG facilities illustrated in FIGS. 1*a* and 1*b* cool the natural gas to its liquefaction temperature using cascade-type cooling in combination with expansion-type cooling. The cascade-type cooling is carried out in three mechanical refrigeration cycles; a propane refrigeration cycle, followed by an ethylene refrigeration cycle, followed by a methane refrigeration cycle. The methane refrigeration cycle includes a heat exchange cooling section followed by an expansion-type cooling section. The LNG facilities of FIGS. 1*a* and 1*b* also include a heavies removal/NGL recovery system downstream of the propane refrigeration cycle for removing heavy hydrocarbon components from the processed natural gas and recovering the resulting NGL.

FIGS. 1*a* and 1*b* illustrate one embodiment of the inventive LNG facility. The system in FIG. 1*a* can sequentially cool natural gas to its liquefaction temperature via three mechanical refrigeration stages in combination with an expansion-type cooling section as described in detail below. FIG. 1*b* illustrates one embodiment of a heavies removal/NGL recovery system. Lines A, B, C, D and G show how the heavies removal/NGL recovery system illustrated in FIG. 1*b* is integrated into the LNG facility of FIG. 1*a*. In accordance with one embodiment of the present invention, the LNG facility can be operated in such a way to maximize propane and heavier component recovery in the NGL product (also referred to herein as "$C_3$+ recovery").

As illustrated in FIG. 1*a*, the main components of the propane refrigeration cycle include a propane compressor 10, a propane cooler 12, a high-stage propane chiller 14, an intermediate stage propane chiller 16, and a low-stage propane chiller 18. The main components of the ethylene refrigeration cycle include an ethylene compressor 20, an ethylene cooler 22, a high-stage ethylene chiller 24, an intermediate-stage ethylene chiller 26, a low-stage ethylene chiller/condenser 28, and an ethylene economizer 30. The main components of the indirect heat exchange portion of the methane refrigeration cycle include a methane compressor 32, a methane cooler 34, a main methane economizer 36, and a secondary methane economizer 38. The main components of the expansion-type cooling section of the methane refrigeration cycle include a high-stage methane expander 40, a high-stage methane flash drum 42, an intermediate-stage methane expander 44, an intermediate-stage methane flash drum 46, a low-stage methane expander 48, and a low-stage methane flash drum 50.

The operation of the LNG facility illustrate in FIG. 1*a* will now be described in more detail, beginning with the propane refrigeration cycle. Propane is compressed in multi-stage (e.g., three-stage) propane compressor 10 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 12 wherein it is cooled and liquefied via indirect heat exchange with an external fluid (e.g., air or water). A representative pressure and temperature of the liquefied propane refrigerant exiting propane cooler 12 is about 100° F. and about 190 psia. The stream from propane cooler 12 is passed through conduit 302 to a pressure reduction means, illustrated as expansion valve 56, wherein the pressure of the liquefied propane is reduced, thereby evaporating or flashing a portion thereof. The resulting two-phase product then flows through conduit 304 into high-stage propane chiller 14. High-stage propane chiller 14 cools the incoming gas streams, including the methane refrigerant recycle stream in conduit 152, the natural gas feed stream in conduit 100, and the ethylene refrigerant recycle stream in conduit 202 via indirect heat exchange means 4, 6, and 8, respectively. Cooled methane refrigerant gas exits high-stage propane chiller 14 through conduit 154 and is fed to main methane economizer 36, which will be discussed in greater detail in a subsequent section.

The cooled natural gas stream from high-stage propane chiller 14, also referred to herein as the methane-rich stream, flows via conduit 102 to a separation vessel 58 wherein gas and liquid phases are separated. The liquid phase, which can be rich in $C_3$+ components, is removed via conduit 303. The vapor phase is removed via conduit 104 and fed to intermediate-stage propane chiller 16 wherein the stream is cooled via an indirect heat exchange means 62. The resultant vapor/liquid stream is then routed to low-stage propane chiller 18 via conduit 112 wherein it is cooled by an indirect heat exchange means 64. The cooled methane-rich stream then flows through conduit 114 and enters high-stage ethylene chiller 24, which will be discussed further in a subsequent section.

The propane gas from high-stage propane chiller 14 is returned to the high-stage inlet port of propane compressor 10 via conduit 306. The residual liquid propane is passed via conduit 308 through a pressure reduction means, illustrated here as expansion valve 72, whereupon an additional portion of the liquefied propane is flashed or vaporized. The resulting cooled, two-phase stream enters intermediate-stage propane chiller 16 by means of conduit 310, thereby providing coolant for chiller 16. The vapor portion of the propane refrigerant exits intermediate-stage propane chiller 16 via conduit 312 and is fed to the intermediate-stage inlet port of propane compressor 10. The liquid portion flows from intermediate-stage propane chiller 16 through conduit 314 and is passed through a pressure-reduction means, illustrated here as expansion valve 73, whereupon a portion of the propane refrigerant stream is vaporized. The vaporized propane refrigerant stream then exits low-stage propane chiller 18 via conduit 318 and is routed to the low-stage inlet port of propane compressor 10, whereupon it is compressed and recycled through the previously described propane refrigeration cycle.

As previously noted, the ethylene refrigerant stream in conduit 202 is cooled in high-stage propane chiller 14 via indirect heat exchange means 8. The cooled ethylene refrigerant stream then exits high-stage propane chiller 14 via conduit 204. The partially condensed stream enters intermediate-stage propane chiller 16, wherein it is further cooled by an indirect heat exchange means 66. The two-phase ethylene stream is then routed to low-stage propane chiller 18 by means of conduit 206 wherein the stream is totally condensed or condensed nearly in its entirety via indirect heat exchange means 68. The ethylene refrigerant stream is then fed via conduit 208 to a separation vessel 70 wherein the vapor portion, if present, is removed via conduit 210. The liquid ethylene refrigerant is then fed to the ethylene economizer 30 by means of conduit 212. The ethylene refrigerant at this location in the process is generally at a temperature of about −24° F. and a pressure of about 285 psia.

Turning now to the ethylene refrigeration cycle illustrated in FIG. 1*a*, the ethylene in conduit 212 enters ethylene economizer 30 and is cooled via an indirect heat exchange means 75. The sub-cooled liquid ethylene stream flows through conduit 214 to a pressure reduction means, illustrated here as expansion valve 74, whereupon a portion of the stream is flashed. The cooled, vapor/liquid stream then enters high-stage ethylene chiller 24 through conduit 215. A portion of the partially vaporized methane rich stream exiting low-stage propane chiller 18 via conduit 114, is routed via conduit B to the heavies removal/NGL recovery system of the LNG facility illustrated in FIG. 1*b*. The remaining portion of the partially vaporized, methane-rich stream exiting low-stage propane chiller 18 via conduit 114 enters the high-stage ethylene chiller 24, wherein it is further condensed via an indirect heat exchange means 82. The cooled methane-rich stream exits high-stage ethylene chiller 24 via conduit 116, whereupon a portion of the stream is routed via conduit A to the heavies removal/NGL recovery system of the process in FIG. 1*b*. Details of FIG. 1*b* will be discussed in a subsequent section. Prior to entering the intermediate stage ethylene chiller 26, a stream from the heavies removal/NGL recovery system in conduit C from FIG. 1*b* combines with the remaining cooled methane-rich stream.

The ethylene refrigerant vapor exits high-stage ethylene chiller 24 via conduit 216 and is routed back to the ethylene economizer 30, warmed via an indirect heat exchange means 76, and subsequently fed via conduit 218 to the high-stage inlet port of ethylene compressor 20. The liquid portion of the ethylene refrigerant stream exits high-stage ethylene chiller 24 via conduit 220 and is then further cooled in an indirect heat exchange means 78 of ethylene economizer 30. The resulting cooled ethylene stream exits ethylene economizer 30 via conduit 222 and passes through a pressure reduction means, illustrated here as expansion valve 80, whereupon a portion of the ethylene is flashed.

In a manner similar to high-stage ethylene chiller 24, the two-phase refrigerant stream enters the first intermediate-stage ethylene chiller 26 via conduit 224, wherein it acts as a coolant for the natural gas stream flowing through an indirect heat exchange means 84. The cooled methane-rich stream exiting the first high-stage ethylene chiller 24 via conduit A is condensed nearly in its entirety. The stream is then routed to the heavies removal/NGL recovery system of the process in FIG. 1*b*, as discussed later.

The vapor and liquid portions of the ethylene refrigerant stream exit intermediate-stage ethylene chiller 26 via conduits 226 and 228, respectively. The gaseous stream in conduit 226 combines with a yet to be described ethylene vapor stream in conduit 238. The combined ethylene refrigerant stream enters ethylene economizer 30 via conduit 239, is warmed by an indirect heat exchange means 86, and is fed to the low-stage inlet port of ethylene compressor 20 via conduit 230. The effluent from the low-stage of the ethylene compressor 20 is routed to an inter-stage cooler 88, cooled, and returned to the high-stage port of the ethylene compressor 20. Preferably, the two compressor stages are a single module although they may each be a separate module, and the modules may be mechanically coupled to a common driver. The compressed ethylene product flows to ethylene cooler 22 via conduit 236 wherein it is cooled via indirect heat exchange with an external fluid (e.g., air or water). The resulting condensed ethylene stream is then introduced via conduit 202 to high-stage propane chiller 14 for additional cooling as previously noted.

The liquid portion of the ethylene refrigerant stream from intermediate-stage ethylene chiller 26 in conduit 228 enters low-stage ethylene chiller/condenser 28 and cools the methane-rich stream in conduit 120 via an indirect heat exchange means 90. The stream in conduit 120 flows into low stage ethylene chiller/condenser 28, wherein it is cooled and condensed via indirect heat exchange means 90. The vaporized ethylene refrigerant from low-stage ethylene chiller/condenser 28 flows via conduit 238 and joins the ethylene vapors from the intermediate-stage ethylene chiller in conduit 226. The combined ethylene refrigerant vapor stream is then heated by the indirect heat exchange means 86 in the ethylene economizer 30 as described previously. The pressurized, LNG-bearing stream exiting the ethylene refrigeration cycle via conduit 122 can be at a temperature in the range of from about −200 to about −50° F., about −175 to about −100° F., or −150 to −125° F. and a pressure in the range from about 500 to about 700 psia, or 550 to 725 psia.

The pressurized, LNG-bearing stream is then routed to main methane economizer 36, wherein it is further cooled by an indirect heat exchange means 92. The stream exits through conduit 124 and enters the expansion-cooling section of the methane refrigeration cycle. The liquefied methane-rich stream is then passed through a pressure-reduction means, illustrated here as high-stage methane expander 40, whereupon a portion, of the stream is vaporized. The resulting two-phase product enters high-stage methane flash drum 42 via conduit 163 and the gaseous and liquid phases are separated. The high-stage methane flash gas is transported to main methane economizer 36 via conduit 155 wherein it is heated via an indirect heat exchange means 93 and exits main methane economizer 36 via conduit 168 and enters the high-stage inlet port of methane compressor 32.

The liquid product from high-stage flash drum 42 enters secondary methane economizer 38 via conduit 166, wherein the stream is cooled via an indirect heat exchange means 39. The resulting cooled stream flows via conduit 170 to a pressure reduction means, illustrated here as intermediate-stage methane expander 44, wherein a portion of the liquefied methane stream is vaporized. The resulting two-phase stream in conduit 172 then enters intermediate-stage methane flash drum 46 wherein the liquid and vapor phases are separated and exit via conduits 176 and 178, respectively. The vapor portion enters secondary methane economizer 38, is heated by an indirect heat exchange means 41, and then reenters main methane economizer 36 via conduit 188. The stream is further heated by indirect heat exchange means 95 before being fed into the intermediate-stage inlet port of methane compressor 32 via conduit 190.

The liquid product from the bottom of intermediate-stage methane flash drum 46 then enters the final stage of the expansion cooling section as it is routed via conduit 176 through a pressure reduction means, illustrated here as low-stage methane expander 48, whereupon a portion of the liquid stream is vaporized. The cooled, mixed-phase product is routed via conduit 186 to low-stage methane flash drum 50, wherein the vapor and liquid portions are separated. The LNG product, which is at approximately atmospheric pressure, exits low-stage methane flash drum 50 via conduit 198 and is routed to storage, represented by LNG storage vessel 99.

As shown in FIG. 1*a*, the vapor stream exits low-stage methane flash drum 50 via conduit 196 and enters secondary methane economizer 38 wherein it is heated via an indirect heat exchange means 43. The stream then travels via conduit 180 to main methane economizer 36 wherein it is further cooled by an indirect heat exchange means 97. The vapor then enters the intermediate-stage inlet port of methane compressor 32 by means of conduit 182. The effluent from the low-stage of methane compressor 32 is routed to an inter-stage cooler 29, cooled, and returned to the intermediate-stage port of the methane compressor 32. Analogously, the intermediate-stage methane vapors are sent to an inter-stage cooler 31, cooled, and returned to the high-stage inlet port of methane compressor 32. Preferably, the three compressor stages are a single module, although they may each be a separate module and the modules may be mechanically coupled to a common driver. In the methane refrigeration cycle of FIG. 1*a*, an additional stream in conduit G from the yet-to-be-discussed heavies removal/NGL recovery system goes to the fuel gas system 195 along with a portion of the resulting compressed methane product via conduit 193. The remaining portion of the resulting compressed methane product flows through conduit 192 whereupon the product is combined with an additional stream in conduit D from the yet-to-be-discussed heavies removal/NGL recovery system. The resulting combined stream is routed to methane cooler 34, wherein the stream is cooled via indirect heat exchange with an external fluid (e.g., air or water). The product of cooler 34 is then introduced via conduit 152 to high-stage propane chiller 14 for additional cooling as previously discussed.

Turning now to FIG. 1*b*, one embodiment of the heavies removal/NGL recovery system of the LNG facility will now be described. The main components of FIG. 1*b* include a first distillation column 652, a second distillation column 654, and an economizing heat exchanger 602. According to one embodiment of the present invention, the reflux stream to first distillation column 652 is comprised predominately of methane. In accordance with one embodiment of the present invention, first distillation column 652 can be refluxed with a stream predominately comprised of ethane.

The operation of the inventive system illustrated in FIG. 1*b* will now be described in more detail. A partially vaporized, methane rich stream in conduit B enters economizing heat exchanger 602, wherein the stream is further condensed via an indirect heat exchange means 614. The cooled stream exits economizing heat exchanger 602 via conduit 628 and combines with the stream in conduit A. The resulting stream is then introduced to first distillation column 652 via conduit 626. A predominately methane overhead product exits first distillation column 652 and reenters the liquefaction stage via conduit C.

As shown in FIG. 1*b*, the bottoms liquid product from distillation column 652 is introduced to economizing heat exchanger 602, wherein the stream is warmed via indirect heat exchanger means 618. The resulting warmed stream exits economizing heat exchanger 602 via conduit 638. A portion of the warmed stream exiting economizing heat exchanger 602 via conduit 638 is routed back to first distillation column 652 via conduit 630. The remaining portion of the warmed stream exiting economizing heat exchanger 602 feeds second distillation column 654 via conduit 638.

The vapor product from the overhead port of second distillation column 654 exits via conduit 640 and is thereafter condensed via condenser 620 by indirect heat exchange with an external fluid (e.g., air or water, propane or ethylene). The resulting cooled, at least partially condensed stream flows via conduit 642 to second distillation column separation vessel 604, wherein the vapor and liquid phases are separated. The liquid portion flows via conduit 662 to the suction of a reflux pump 606. The stream then discharges into conduit 664 and is employed as a second distillation column 654 reflux stream.

The vapor stream exits second distillation column separation vessel 604 via conduit 634. One portion of the vapor stream can be routed by way of conduit D for combining with the methane compressor discharge. Another fraction of the vapor product can be routed via conduit G to fuel in FIG. 1*a*, as previously described.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention.

The invention claimed is:

1. A process for liquefying a natural gas stream in a liquefied natural gas (LNG) facility, the process comprising:

a) providing a heavies/NGL recovery system that comprises a first distillation column and a second distillation column wherein the second distillation column is an natural gas liquids (NGL) column;

b) introducing a first portion of the natural gas stream from a liquefaction system into a first heat exchanger to produce a first cooled stream;

c) introducing a second portion of the natural gas stream into the first distillation column, wherein prior to entry into the first distillation column the stream is combined with the first cooled stream to form a combined stream;

d) using the first distillation column to separate the combined stream into a first predominately vapor stream and a first predominately liquid bottoms stream;

e) removing the first predominately vapor stream from the first distillation column and reintroducing the first predominately vapor stream into the liquefaction system;

f) removing the first predominately liquid bottoms stream from the first distillation column and introducing the first predominately liquid bottoms stream into the first heat exchanger to produce a first heated stream;

g) separating the first heated stream to form a portion of first heated stream and a remaining portion of the first heated stream, wherein the portion of the first heated stream is introduced into the bottom of the first distillation column;

h) introducing the remaining portion of the first heated stream into the second distillation column;

i) using the second distillation column to separate at least a portion of the remaining portion of the first heated stream into a second predominately liquid bottoms stream and a second predominately vapor stream;

j) removing the second predominately vapor stream from the second distillation column and introducing the second predominately vapor stream into a second heat exchanger in indirect heat exchange with an external coolant to produce a second cooled stream;

k) introducing the second cooled stream into a separation vessel to separate the second cooled stream into a third vapor fraction and a third liquid fraction;

l) introducing at least a portion of the third vapor fraction into a fuel gas system fuel gas, wherein the at least a portion of the third vapor fraction is relatively concentrated in ethane and propane; and m) returning a portion of the third vapor fraction to a methane system component of the liquefaction system.

2. The process of claim 1, wherein the natural gas stream is cooled in an upstream refrigeration cycle prior to the first portion of the natural gas stream being introduced into the first heat exchanger.

3. The process of claim 1, wherein at least one of the first and the second heat exchangers is a shell-and-tube heat exchanger.

4. The process of claim 1, wherein at least one of the first and second heat exchangers is not a brazed aluminum heat exchanger.

5. The process of claim 1, wherein the first heat exchanger is a shell-and-tube heat exchanger.

6. The process of claim 1, wherein the second heat exchanger is a kettle-type shell-and-tube heat exchanger.

7. The process of claim 1, further comprising cooling at least a portion of the natural gas stream via indirect heat exchange with a first refrigerant, further comprising cooling at least a portion of the natural gas stream via indirect heat exchange with a second refrigerant, further comprising cooling at least a portion of the first predominately vapor stream via indirect heat exchange with a third refrigerant, further comprising cooling at least a portion of the first predominately vapor stream via pressure reduction, wherein the first, second, and third refrigerants have sequentially lower boiling points, wherein the cooling with the first refrigerant is carried out upstream of the first distillation column, wherein at least a portion of the cooling with the second refrigerant is carried out upstream of the first distillation column, wherein the cooling via pressure reduction or the cooling via indirect heat exchange with the third refrigerant causes at least a portion of the first predominately vapor stream to condense into liquefied natural gas (LNG).

8. The process of claim 7, wherein at least one of the first refrigerant and the second refrigerant is predominately one of propane, propylene, ethane, ethylene, or mixtures of two or more thereof.

9. The process of claim 1, wherein the first distillation column comprises in the range of from about 2 to about 20 theoretical stages.

10. The process of claim 1, wherein the second distillation column comprises in the range of from about 2 to about 20 theoretical stages.

11. The process of claim 1, wherein separating the third cooled stream into a third vapor fraction and a third liquid fraction in step k) controls or maintains heating value of LNG produced from the liquefaction system.

* * * * *